US007406789B2

(12) United States Patent
Story

(10) Patent No.: US 7,406,789 B2
(45) Date of Patent: Aug. 5, 2008

(54) INFORMATION BAND

(75) Inventor: Nina Story, Enskede (SE)

(73) Assignee: DGInvest AB, Viken (SE)

( * ) Notice: Subject to any disclaimer, the term of this patent is extended or adjusted under 35 U.S.C. 154(b) by 185 days.

(21) Appl. No.: 10/509,613

(22) PCT Filed: Apr. 4, 2003

(86) PCT No.: PCT/SE03/00555

§ 371 (c)(1),
(2), (4) Date: May 18, 2005

(87) PCT Pub. No.: WO03/088190

PCT Pub. Date: Oct. 23, 2003

(65) Prior Publication Data

US 2005/0235539 A1 Oct. 27, 2005

(30) Foreign Application Priority Data

Apr. 5, 2002 (SE) ..... 0201038

(51) Int. Cl.

| | |
|---|---|
| ***A44C 5/00*** | (2006.01) |
| ***A44B 5/00*** | (2006.01) |
| ***A44B 1/04*** | (2006.01) |
| ***A44B 11/00*** | (2006.01) |
| ***G09F 3/02*** | (2006.01) |
| ***B68B 5/00*** | (2006.01) |
| ***B63B 21/08*** | (2006.01) |

(52) U.S. Cl. ..... 40/633; 40/625; 24/133; 24/170; 24/134 KB; 24/173

(58) Field of Classification Search ..... 40/633, 40/625; 24/170, 173, 134 KB
See application file for complete search history.

(56) References Cited

U.S. PATENT DOCUMENTS

| | | | | |
|---|---|---|---|---|
| 3,713,622 | A | 1/1973 | Dinger | |
| 3,983,604 | A | 10/1976 | Phillips | |
| 4,387,489 | A * | 6/1983 | Dudek | 24/133 |
| 4,815,175 | A * | 3/1989 | Kasai | 24/193 |
| 5,577,395 | A | 11/1996 | Kuykendall | |
| 5,979,095 | A * | 11/1999 | Schneider et al. | 40/633 |

FOREIGN PATENT DOCUMENTS

WO WO 0199088 A1 12/2001

* cited by examiner

*Primary Examiner*—Lesley D. Morris
*Assistant Examiner*—Syed A Islam
(74) *Attorney, Agent, or Firm*—Dowell & Dowell P.C.

(57) ABSTRACT

An information band (1) for fitting around a wrist of a wearer and for containing information about the wearer. The information band includes a clip (2) and a band (3). The clip (2) has a lid part (5) pivotably connected to a bottom part (4), at least one bulge formed between the lid and bottom parts (4, 5), and a locking device. The lid and bottom parts (4, 5) close to fix the band (3) in position around the wrist by a strong squeezing force resulting from a lockable, snappable co-operation between parts of the locking device during application of the information band so that a two-handed grip is required to open the clip and release the band.

2 Claims, 3 Drawing Sheets

INFORMATION BAND

BACKGROUND OF THE INVENTION

1. Field of the Invention

The present invention refers to an information band comprising as an example person- and address information and/or other actual information and which consists of a clip and a band intended to be fastened around the wrist of a wearer by aid of said clip.

2. Brief Description of Related Art

Today great problems can arise if for example a child for some reason should disappear, e.g. in large stores, markets or during a vacation abroad on a beach. In such circumstances one can, what concerns stores and markets, let a person in an information department ask in a loud-speaker system for the name of the child but in case the child or the children are not so old they do not understand what is said in a loud-speaker. Thus to find such a lost child can require large measures and efforts. Another problem of similar kind can be what concerns old seniledement persons who, for some reasons, have gone out from a home for old people or the like. A further problem can be when you must verify acceptance during e.g. passage control, opening functions for persons during different meetings, where only authorized persons are allowed to pass certain controls.

SUMMARY OF THE INVENTION

The object of the present invention is to provide an information band, which can be fastened on the wrist of a wearer and which is intended to contain person- and address information, some kind of equipment in order to find or localize the person in question or a data chip, which has been programmed with actual information e.g. an ID-chip for passage control. The characterizing features of the invention are set forth in the claims enclosed.

Thanks to the invention an information band has now been provided, which is easy to fasten with its special clip around the wrist of a wearer. Further, the clip has such a function that the same only with a great effort can be loosened by e.g. a child or the person in question wearing said band in that it is required a two-handed grip to open the clip and to loosen the band from its fixing position. If required, the band can contain over and above information about name and phone numbers also information about eventual sickness, which can be important for the person in question in a precarious or exposed situation. The band can also include a data chip for passage control, which essentially can make the existence easier for those persons, which are present in meetings having a high security. The clip per se can be re-used and the band can be exchanged as many times as it is necessary if the text should need to be changed or its contents is inactual or not correct. Extra bands can be sold as extra fittings. The clip functions in such a way that after placing the same around the wrist of a wearer the same is snapped into a fixed position around the wrist and is thereafter located in the fixed position desired on the wrist. The information band is in this way fastened in a safe way by aid of the clip.

BRIEF DESCRIPTION OF THE DRAWINGS

The invention is described in more detail below by aid of a preferred embodiment example in view of the drawings enclosed, on which

DETAILED DESCRIPTION OF PREFERRED EMBODIMENTS

Figure 1:
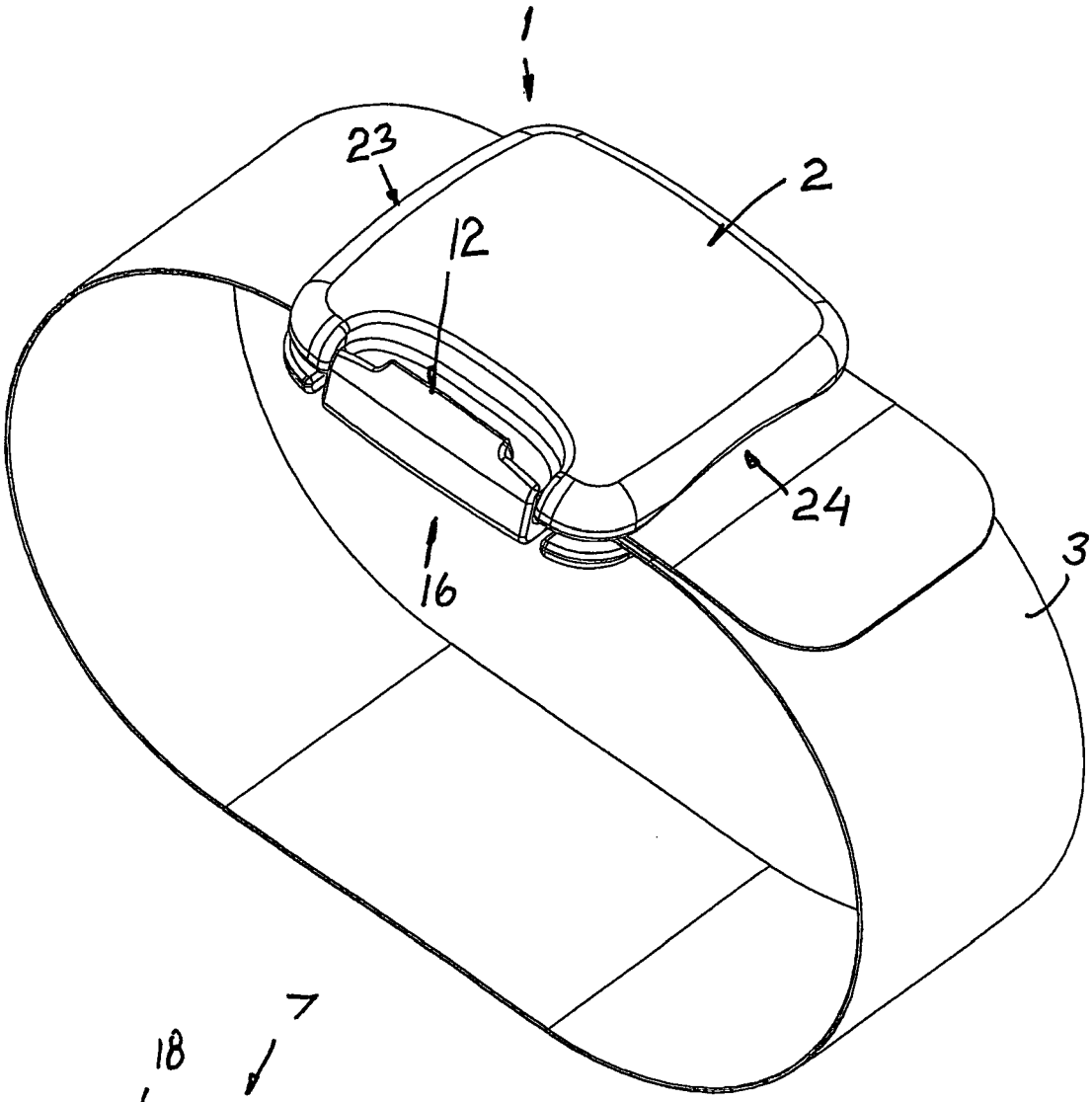
FIG. 1 shows a cross-section of an information band according to the present invention having a clip fastened together for fixing the band in position around the wrist of a wearer.
Figure 2:
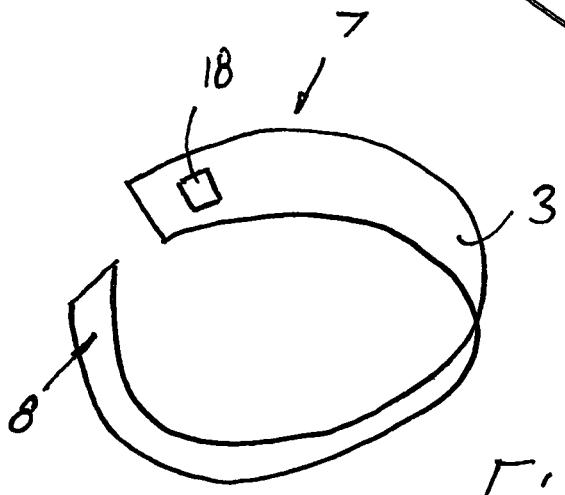
FIG. 2 shows a schematic perspective view of a band intended to be used together with the clip.
Figure 3:
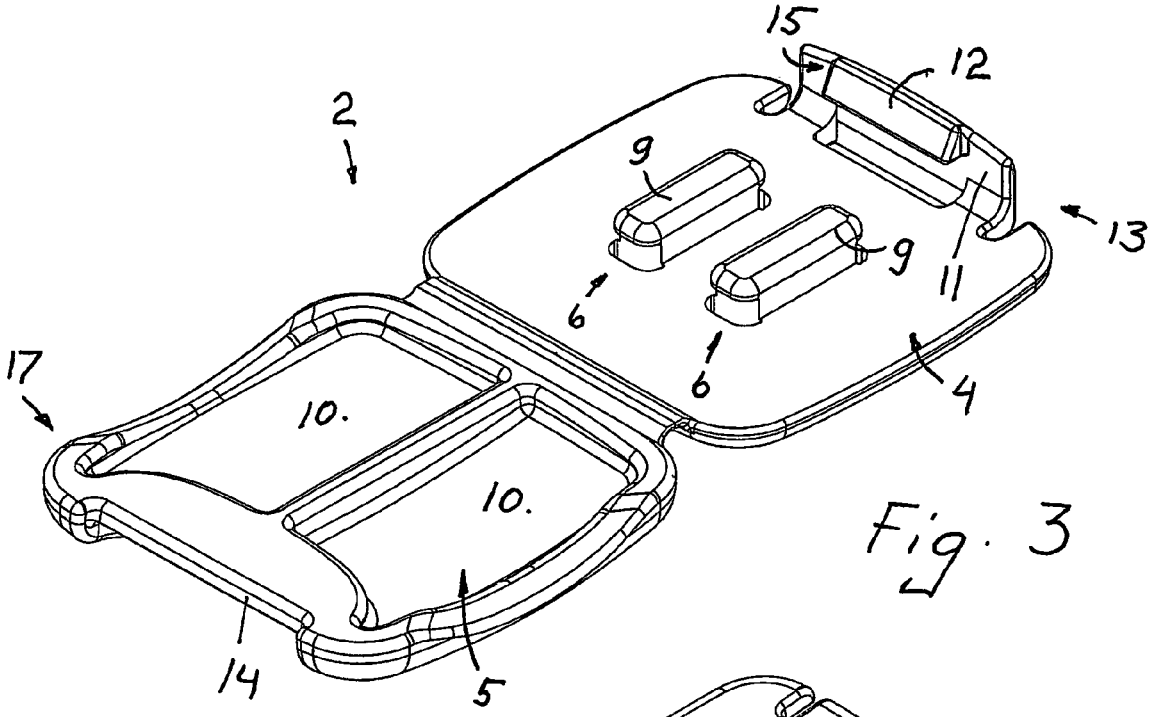
FIG. 3 shows a schematic perspective view of a clip belonging to the information band in an open position.
Figure 4:
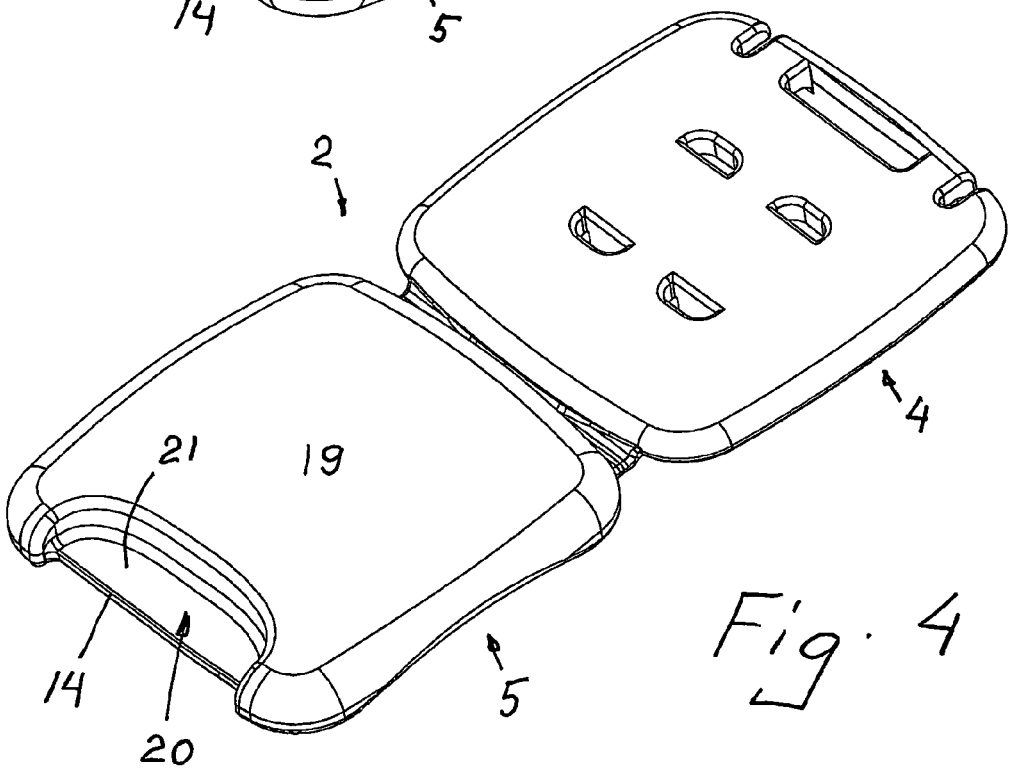
FIG. 4 shows a schematic perspective view from the other side of the clip according to FIG. 3.
Figure 5:
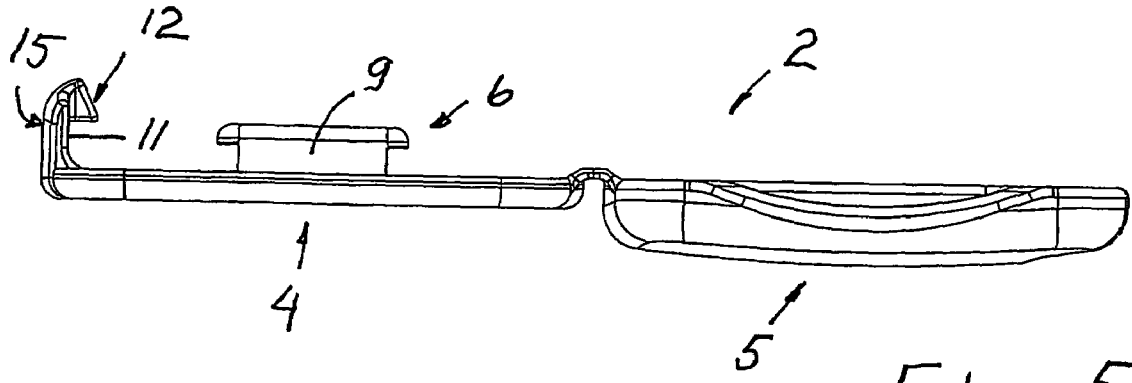
FIG. 5 shows a side view of the clip according to FIG. 3 in a totally open position before application of a band over squeezing means in the bottom part of the clip.
Figure 6:
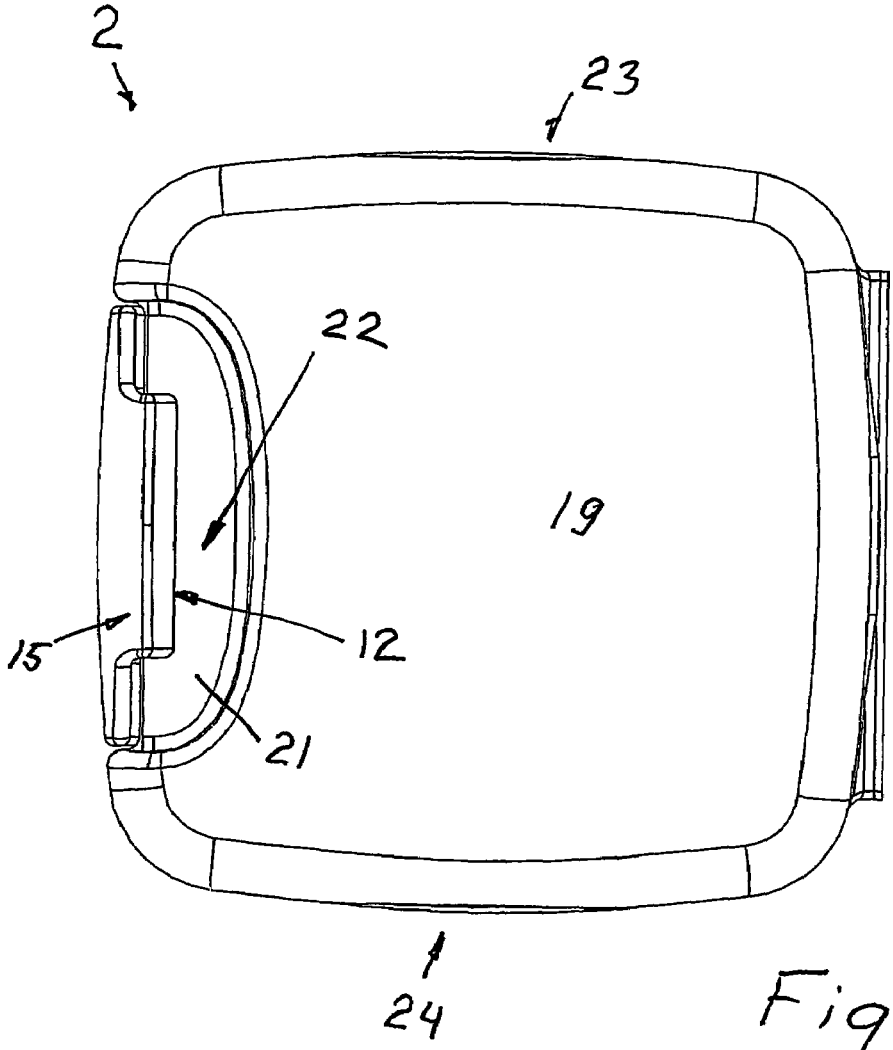
FIG. 6 shows a view from above of the clip in a closed position with the band.

As can be seen from the drawings a preferred embodiment example is illustrated of an information band 1 according to the present invention. Said information band 1 can contain person- and address information or other information, which refers to a person or wearer having the information band. The band 1 consists mainly of two parts, namely a clip 2 and a band 3. The clip 2 comprises a lid part 5 pivotably connected to a bottom part 4. Two squeezing means 6 are provided between the parts 4 and 5 and when the bottom part 4 and the lid part 5 have been closed together in a direction towards each other end portions 7 and 8 of the band 3 are squeezed together and fixed in position as soon as said bottom part 4 and lid part 5 have been snapped together by aid of a locking device 16 located in the free ends of the parts 4,5. When loosening of the locking device 16 and taking off said information band 1 from the wrist a two-handed grip must be made owing to the high squeezing force of the squeezing means 6 after the snapping together of the parts 4,5 to each other by aid of the locking device 16.

Each squeezing means 6 consists of a male bulge 9 in the example illustrated, which is formed in the bottom part 4 in co-operation against a recess 10 formed in the lid part 5 for squeezing of the band 3. In the embodiment example illustrated the clip 2 comprises two squeezing means 6 provided near each other in the bottom part 4 and lid part 5.

The locking device 16 is formed in the free end portions of the bottom part 4 and lid part 5 and consists of a hook formation 12 of the bottom part 4, which is intended to lockably co-operate with an edge portion 14 formed on the lid part 5. The hook formation 12 is formed in the free end 13 of the bottom part 4 on a gable wall 15 protruding upwards from the same, said gable wall 15 is provided with said hook formation 12 on its inside 11. Thus, it can be lockingly snapped fast and co-operate with the edge portion 14 formed on the free end 17 of the lid part 5. In making it easier to fix into position of said information band 1 around the wrist of a wearer, the same can be fastened to the clip 2 in such a way that the one end portion 7 of the band 3, which is provided with an opening 18, is intended to be pressed into a fixed position over said male bulges 9 before the locking of the clip 2. In mounting or fastening of the information band 1 around e.g. a wrist it is only required that the other free end portion 8 of the band 3 is placed in an overlapping manner over the bottom part 4 of the clip 2, whereupon the lid part 5 is snapped into a fixed position over the other end portion 8 of the band 3, as soon as the same has been tensioned in a way strong enough around the wrist of the wearer in question.

During a loosening of the clip 2 from the band 3 and taking off the same from the wrist of the wearer, you have to use a two-handed grip. The loosening of the band 3 can be made easier in that the upper side 19 of the clip 2 or the lid part 5 is provided with a recess 20, the bottom 21 of which ends in said edge portion 14 at the same time as the recess 20, when the clip 2 is snapped together, constitutes a slit portion 22, which makes an accessability possible of said hook formation 12. The clip 2 can therefore be opened during use only by aid of a two-handed grip at the same time as the fingers of the one hand take a grip against the upper side of the lock part 5 or in other words against the opposite edge portions 23, 24 of the lid part 5, which extend in a direction across the length direction of the band 3, at the same time as an actuation is carried out by aid of some or a few other fingers of the other hand against said hook formation 12 itself, so that it is bent outwards in a direction from its locking position at the edge portion 14. This loosening moment can in this way in spite of the high squeezing force of the squeezing means 6 only be made after the snapping together of the parts 4,5 to each other thanks to the special structure of the clip 2.

The invention claimed is:

1. An information band for application around a wrist of a wearer and for containing information about the wearer, comprising: a clip and a band, said clip including a lid part having a front edge, a rear edge, and opposing side edges, a bottom part having a front edge, a rear edge, and opposing side edges, a locking device located on said front edges of said lid and bottom parts, and a squeezing means for exerting a squeezing force to maintain said clip in a closed position formed within and between said lid and bottom parts, said lid and bottom parts being pivotally connected at said rear edges of said lid and bottom parts and being able to be snapped to the closed position by aid of said locking device during a simultaneous squeezing and fixation into position of end portions of said band by aid of said squeezing means during the application of said band, said locking device including a hook formation on a gable wall protruding from said front edge of said bottom part of said clip and an edge portion formed on said front edge of said lid part, said edge portion having an edge recess so that during a snapping together said lid and bottom parts of said clip, said hook formation is received in said edge recess so that said locking device is in a locked position and a slit portion which allows said hook formation to be accessible when said locking device is in the locked position, said squeezing means including at least two bulges formed in said bottom part, at least two recesses formed between said side edges of said lid part, each recess co-operating with a bulge, and a middle string in the form of a wall provided between said at least two recesses, said middle string protruding inwardly between said at least two bulges during a snapping together of said lid and bottom parts of said clip to exert a squeezing force on said end portions of said band positioned over said middle string of said lid part after said locking device is in the locked position, wherein a two-handed grip is required to release said end portions of said band in which one hand grasps said side edges of said lid part of said clip and applies a force to said side edges to overcome the squeezing force applied to said end portions of said band positioned over said middle string of said lid part at the same time as another hand presses said hook formation outwardly from said edge portion so that said locking device is in an unlocked position.

2. The information band according to claim 1, wherein one of said end portions of said band includes an opening for co-operation with said squeezing means.

* * * * *